US012570445B2

(12) United States Patent
Yang et al.

(10) Patent No.: US 12,570,445 B2
(45) Date of Patent: Mar. 10, 2026

(54) CONTROL VALVE AND RELATED CONTAINER KIT

(71) Applicant: Universal Trim Supply Co., Ltd., New Taipei City (TW)

(72) Inventors: Shih-Sheng Yang, Taipei City (TW); Chih-Wei Yang, Taipei City (TW); Aly Khalifa, Raleigh, NC (US)

(73) Assignee: Universal Trim Supply Co., Ltd., New Taipei City (TW)

( * ) Notice: Subject to any disclaimer, the term of this patent is extended or adjusted under 35 U.S.C. 154(b) by 128 days.

(21) Appl. No.: 18/638,614

(22) Filed: Apr. 17, 2024

(65) Prior Publication Data

US 2025/0326537 A1 Oct. 23, 2025

(51) Int. Cl.
*B65D 47/20* (2006.01)
*B65D 81/20* (2006.01)

(52) U.S. Cl.
CPC ..... *B65D 47/2056* (2013.01); *B65D 81/2015* (2013.01); *B65D 81/2061* (2013.01)

(58) Field of Classification Search
CPC ..... B65D 47/2056; B65D 81/2015; B65D 81/2061
See application file for complete search history.

(56) References Cited

U.S. PATENT DOCUMENTS

| | | | |
|---|---|---|---|
| 5,402,919 | A | 4/1995 | Atkinson |
| 6,003,742 | A | 12/1999 | Garcia |
| 6,575,330 | B2 | 6/2003 | Rousselet |
| 2003/0094467 | A1 | 5/2003 | Dark |
| 2022/0106100 | A1 | 4/2022 | Clair |

FOREIGN PATENT DOCUMENTS

| | | | |
|---|---|---|---|
| CN | 1681716 | A | 10/2005 |
| CN | 106232495 | A | 12/2016 |
| CN | 113614000 | A | 11/2021 |
| JP | 2010-500246 | A | 1/2010 |
| KR | 10-2005-0092970 | A | 9/2005 |
| KR | 10-2013-0129512 | A | 11/2013 |
| TW | M652396 | U | 3/2024 |
| WO | 2008/018730 | A1 | 2/2008 |
| WO | 2015/008968 | A1 | 1/2015 |

*Primary Examiner* — Paul J Gray
(74) *Attorney, Agent, or Firm* — Winston Hsu

(57) ABSTRACT

A control valve adapted for a container is provided and includes a valve member and an operating member. The valve member is configured to be mounted on the container and resiliently deformable. The operating member is pivotally switchable between a first position and a second position. When the operating member is operated to the second position from the first position, the valve member is resiliently deformed by the operating member, such that the valve member is at least partially separated from the container. Besides, a related container kit is also provided.

14 Claims, 18 Drawing Sheets

CONTROL VALVE AND RELATED CONTAINER KIT

BACKGROUND OF THE INVENTION

1. Field of the Invention

The present invention relates a control valve adapted for a container and a related container kit, and more specifically, to a control valve capable of being switched between different states by utilizing an operating member and a related container kit.

2. Description of the Prior Art

A valve is an important part in a vacuumizing system or a pressurizing system for allowing or restraining balance of an interior air pressure of a container in the vacuumizing system or the pressurizing system, e.g., a hard box or a soft bag, and an exterior air pressure. However, the conventional valve is not user-friendly. Therefore, an improvement is needed.

SUMMARY OF THE INVENTION

It is an objective of the present invention to provide a control valve capable of being switched between different states by utilizing an operating member and a related container kit for solving the aforementioned problem.

In order to achieve the aforementioned objective, the present invention discloses a control valve adapted for a container. The control valve includes a valve member and an operating member. The valve member is configured to be mounted on the container and resiliently deformable. The operating member is pivotally switchable between a first position and a second position. When the operating member is operated to the second position from the first position, the valve member is resiliently deformed by the operating member, such that the valve member is at least partially separated from the container.

According to an embodiment of the present invention, the valve member includes an abutting portion and a covering portion. The abutting portion is configured to abut against a first side of the container. The covering portion is connected to the abutting portion and configured to be resiliently deformed by at least one of a second side of the container and the operating member.

According to an embodiment of the present invention, the covering portion is not resiliently deformed by the operating member when the operating member is located at the first position, and the covering portion is resiliently deformed by the operating member to be at least partially separated from the second side of the container when the operating member is located at the second position.

According to an embodiment of the present invention, the covering portion is attached on and resiliently deformed by the second side of the container when the operating member is located at the first position.

According to an embodiment of the present invention, the operating member is pivotally disposed on one of the valve member and the container.

According to an embodiment of the present invention, the operating member includes at least one pivoting portion and at least one driving portion. The at least one pivoting portion is pivotally connected to the one of the valve member and the container. The at least one driving portion protrudes from the at least one pivoting portion and configured to abut against another one of the valve member and the container when the operating member is operated to the second position from the first position.

According to an embodiment of the present invention, the at least one driving portion is formed in a cam shape. The at least one driving portion does not abut against the another one of the valve member and the container when the operating member is located at the first position, and the at least one driving portion abuts against the another one of the valve member and the container when the operating member is located at the second position.

According to an embodiment of the present invention, the operating member further includes an operating portion connected to the at least one pivoting portion and configured to be operated to drive the at least one pivoting portion to pivot, so as to switch the operating member between the first position and the second position.

According to an embodiment of the present invention, the at least one pivoting portion is configured to be pivotally connected to a through hole structure or a shaft structure formed on one of a covering portion of the valve member and a valve seat of the container.

According to an embodiment of the present invention, when the operating member is located at the second position, a communication channel is formed between the valve member and the container for producing an audible sound by an airflow through the communication channel.

In order to achieve the aforementioned objective, the present invention discloses a container kit. The container kit includes a container and a control valve. The control valve includes a valve member and an operating member. The valve member is configured to be mounted on the container and resiliently deformable. The operating member is pivotally switchable between a first position and a second position. When the operating member is operated to the second position from the first position, the valve member is resiliently deformed by the operating member, such that the valve member is at least partially separated from the container.

According to an embodiment of the present invention, the valve member includes an abutting portion and a covering portion. The abutting portion is configured to abut against a first side of the container. The covering portion is connected to the abutting portion and configured to be resiliently deformed by at least one of a second side of the container and the operating member.

According to an embodiment of the present invention, the covering portion is not resiliently deformed by the operating member when the operating member is located at the first position, and the covering portion is resiliently deformed by the operating member to be at least partially separated from the second side of the container when the operating member is located at the second position.

According to an embodiment of the present invention, the covering portion is attached on and resiliently deformed by the second side of the container when the operating member is located at the first position.

According to an embodiment of the present invention, the operating member is pivotally disposed on one of the valve member and the container.

According to an embodiment of the present invention, the operating member includes at least one pivoting portion and at least one driving portion. The at least one pivoting portion is pivotally connected to the one of the valve member and the container. The at least one driving portion protrudes from the at least one pivoting portion and configured to abut against another one of the valve member and the container when the operating member is operated to the second position from the first position.

According to an embodiment of the present invention, the at least one driving portion is formed in a cam shape. The at least one driving portion does not abut against the another one of the valve member and the container when the operating member is located at the first position, and the at least one driving portion abuts against the another one of the valve member and the container when the operating member is located at the second position.

According to an embodiment of the present invention, the operating member further includes an operating portion connected to the at least one pivoting portion and configured to be operated to drive the at least one pivoting portion to pivot, so as to switch the operating member between the first position and the second position.

According to an embodiment of the present invention, the at least one pivoting portion is configured to be pivotally connected to a through hole structure or a shaft structure formed on one of a covering portion of the valve member and a valve seat of the container.

According to an embodiment of the present invention, when the operating member is located at the second position, a communication channel is formed between the valve member and the container for producing an audible sound by an airflow through the communication channel.

In summary, the control valve of the present invention can be switched between different states by operating the operating member to different positions for allowing or restraining balance of an interior air pressure of the container and an exterior air pressure. Therefore, the present invention has easy operation. Furthermore, when the operating member is located at the second position, the audible sound can be produced by the airflow through the communication channel formed between the valve member and the container, e.g., until the interior air pressure of the container and the exterior air pressure are balanced. Therefore, it is easy for a user to recognize whether the interior air pressure of the container and the exterior air pressure are balanced or not by hearing the audible sound.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
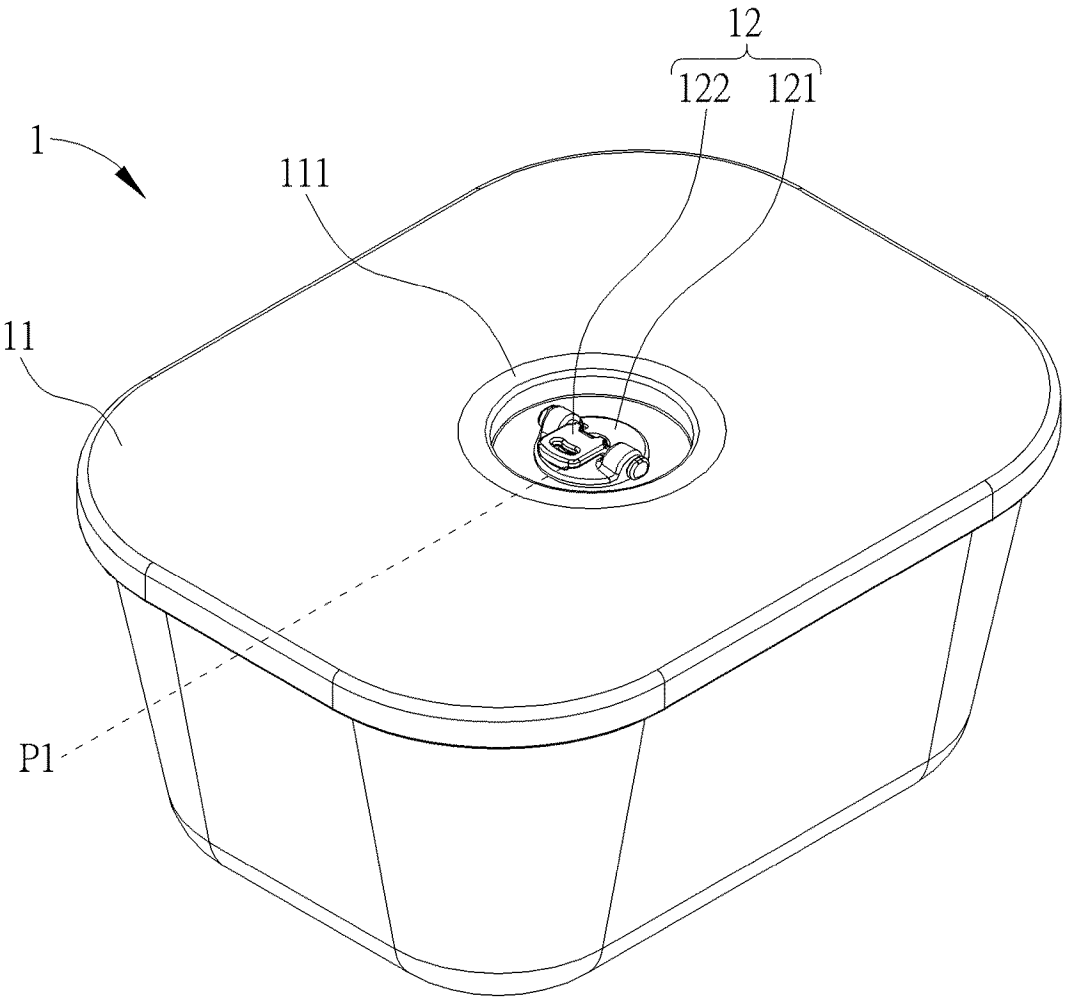
FIG. 1 and FIG. 2 are diagrams of a container kit in different states according to a first embodiment of the present invention.
Figure 2:
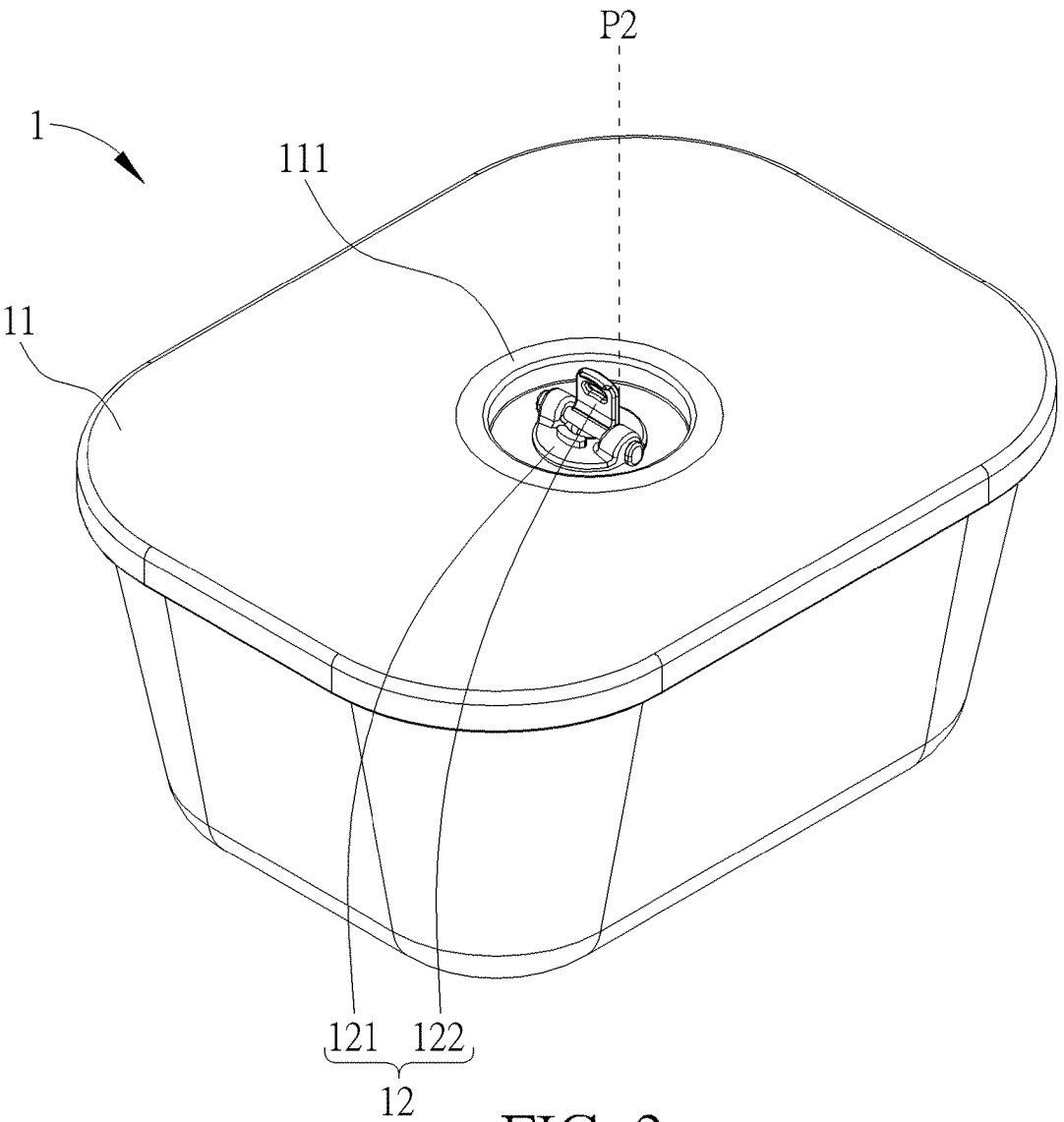
Figure 3:
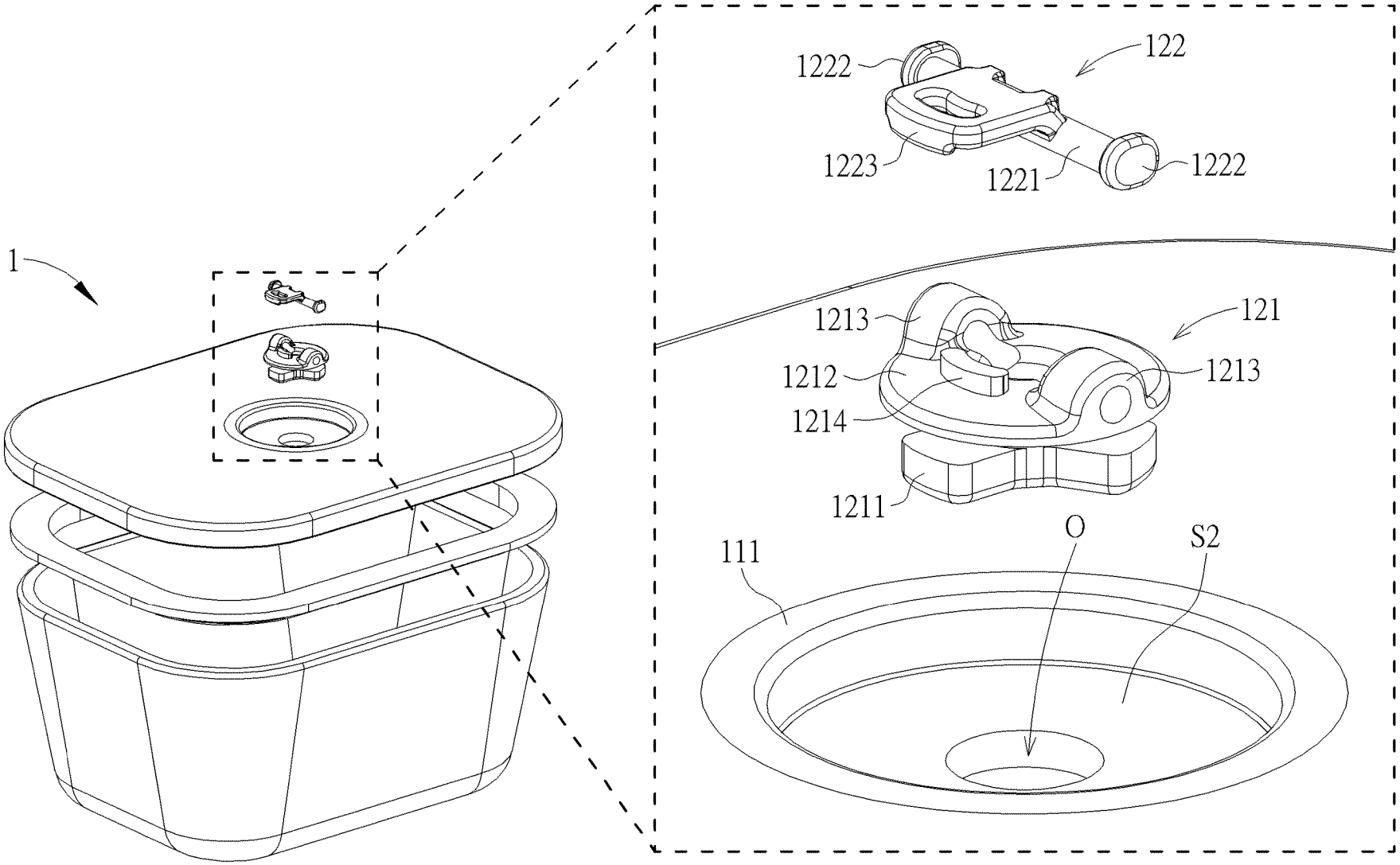
FIG. 3 is an exploded diagram of the container kit according to the first embodiment of the present invention.

Please refer to FIG. 1 to FIG. 3. FIG. 1 and FIG. 2 are diagrams of a container kit 1 in different states according to a first embodiment of the present invention. FIG. 3 is an exploded diagram of the container kit 1 according to the first embodiment of the present invention. As shown in FIG. 1 to FIG. 3, the container kit 1 includes a container 11 and a control valve 12 disposed on the container 11. In this embodiment, the container 11 is a hard box. Besides, the control valve 12 is configured to allow an airflow from an interior of the container 11 to an exterior environment only for vacuumizing the interior of the container 11 when the control valve 12 is in a first state as shown in FIG. 1, and the control valve 12 is further configured to allow both of an airflow from the interior of the container 11 to the exterior environment and an airflow from the exterior environment to the interior of the container 11 for devacuumizing the interior of the container 11 when the control valve 12 is in a second state as shown in FIG. 2.

However, the present invention is not limited to this embodiment. For example, in another embodiment, the container can be a soft bag. Alternatively, in another embodiment, the control valve can be configured to allow an airflow from the exterior environment to the interior of the container only for pressurizing the interior of the container when the control valve is in a first state, and the control valve is further configured to allow both of an airflow from the exterior environment to the interior of the container and an airflow from the interior of the container to the exterior environment for depressurizing the interior of the container when the control valve is in a second state.

As shown in FIG. 1 to FIG. 3, the control valve 12 includes a valve member 121 and an operating member 122. The valve member 121 is configured to be mounted on the container 11 and resiliently deformable. The operating member 122 is pivotally switchable between a first position P1 as shown in FIG. 1 and a second position P2 as shown in FIG. 2 for switching the control valve 12 between the first state as shown in FIG. 1 and the second state as shown in FIG. 2.

Figure 4:
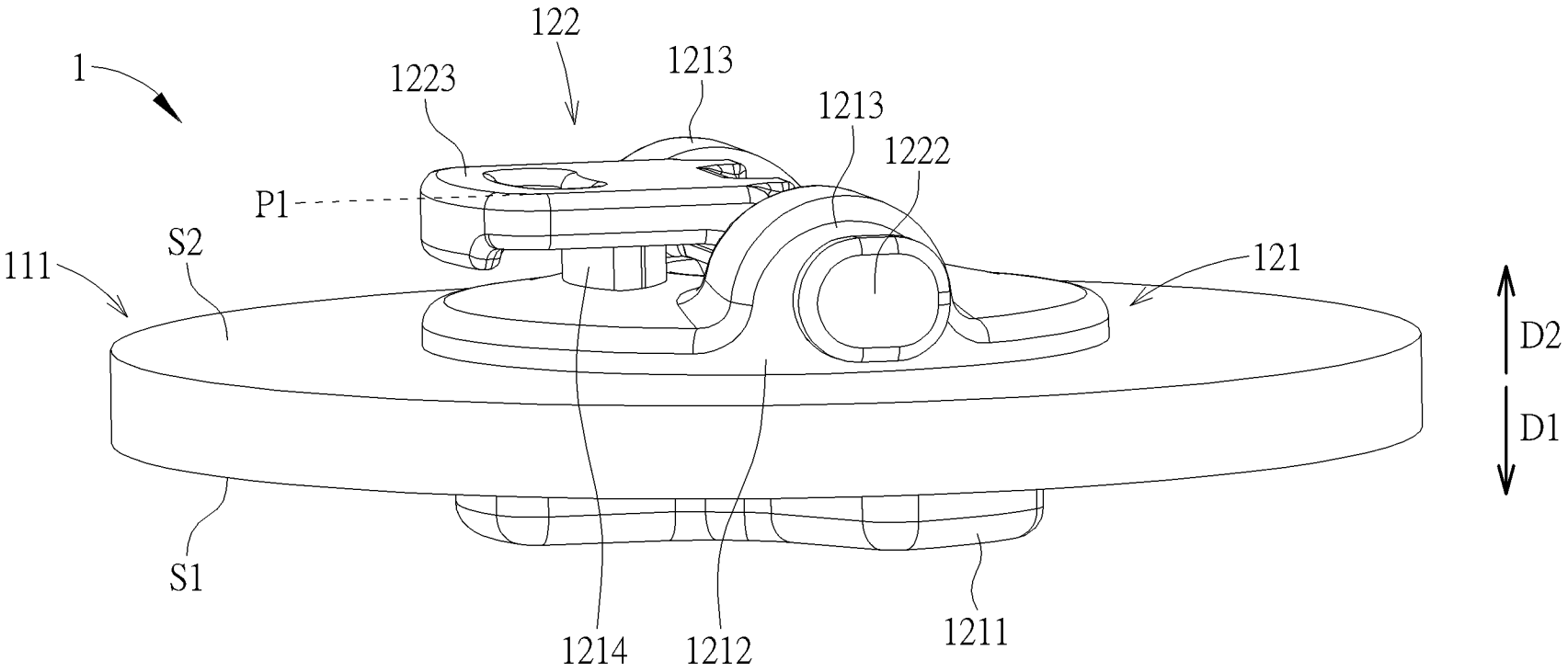
FIG. 4 and FIG. 5 are partial diagrams of the container kit at different views as an operating member is located at a first position according to the first embodiment of the present invention.
Figure 5:
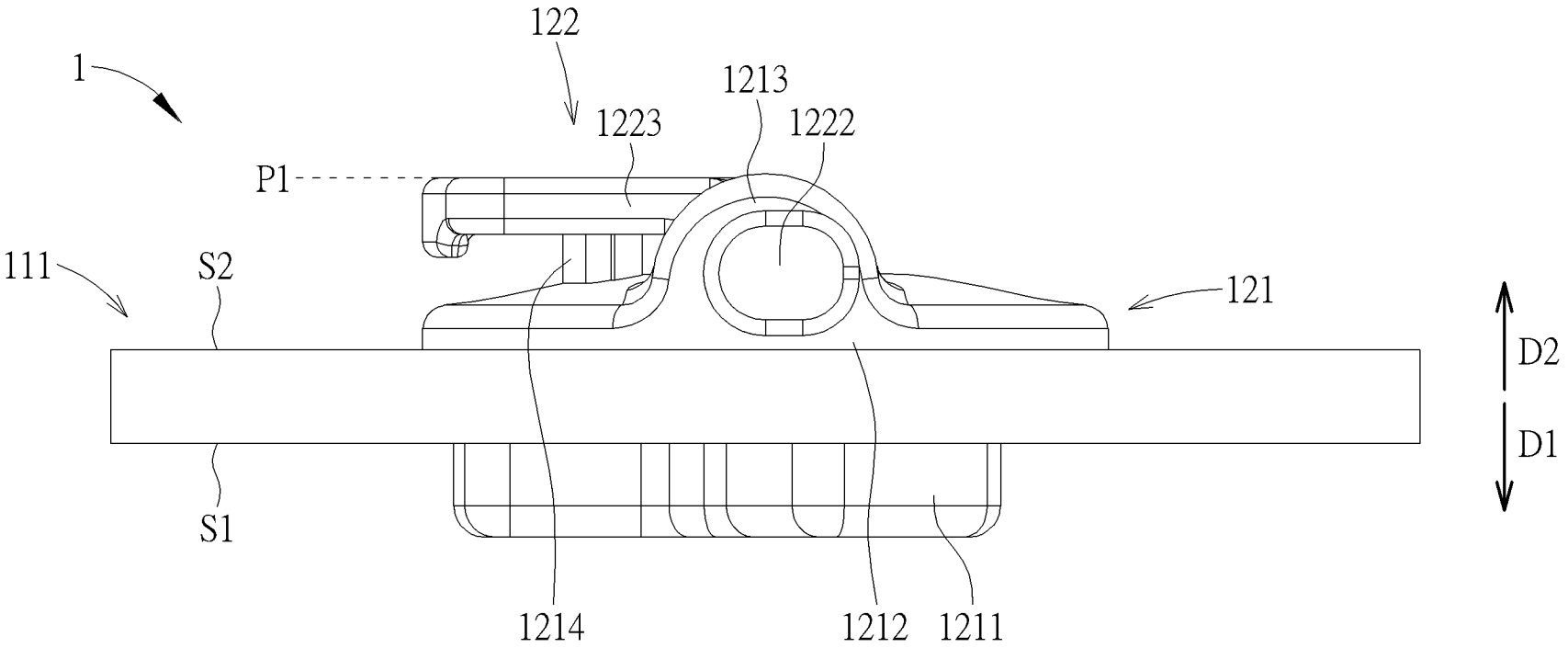
Figure 6:
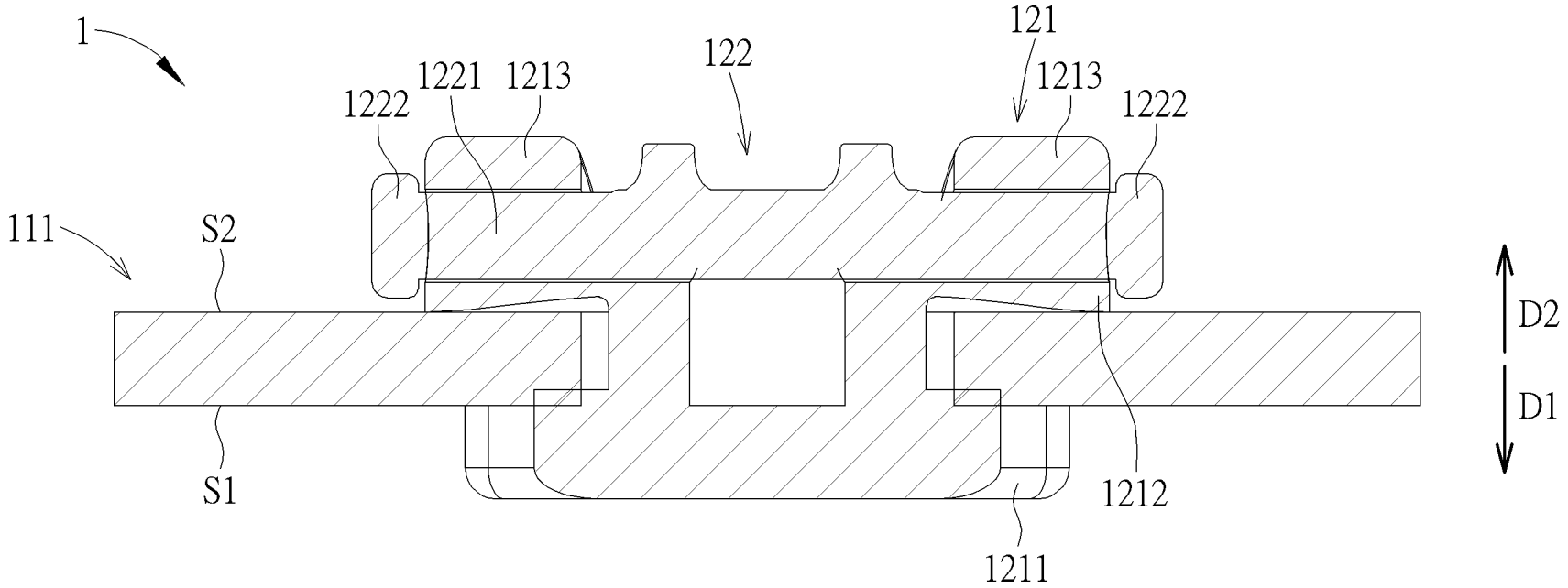
FIG. 6 is a partial sectional diagram of the container kit as the operating member is located at the first position according to the first embodiment of the present invention.
Figure 7:
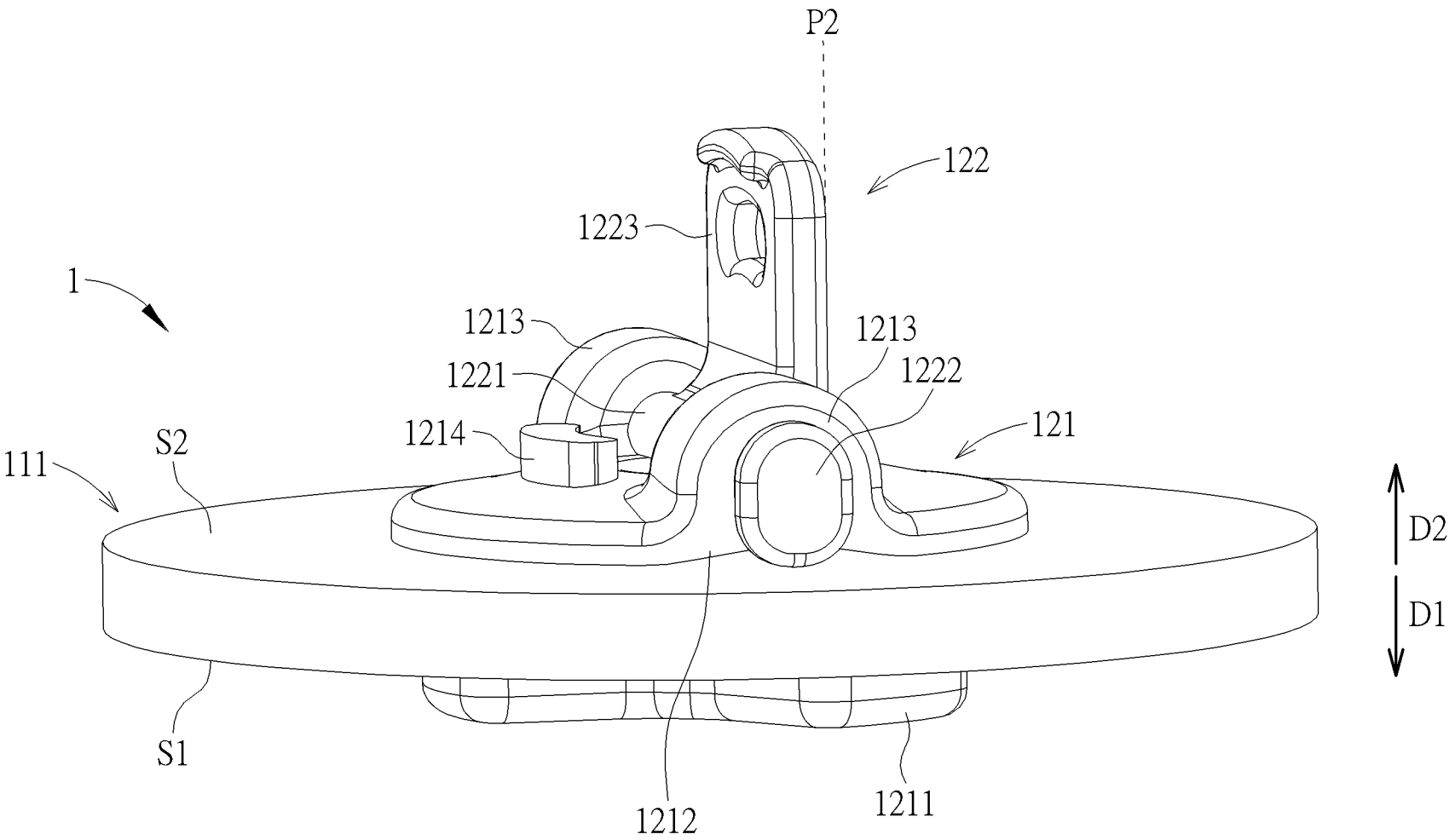
FIG. 7 and FIG. 8 are partial diagrams of the container kit at different views as the operating member is located at a second position according to the first embodiment of the present invention.
Figure 8:
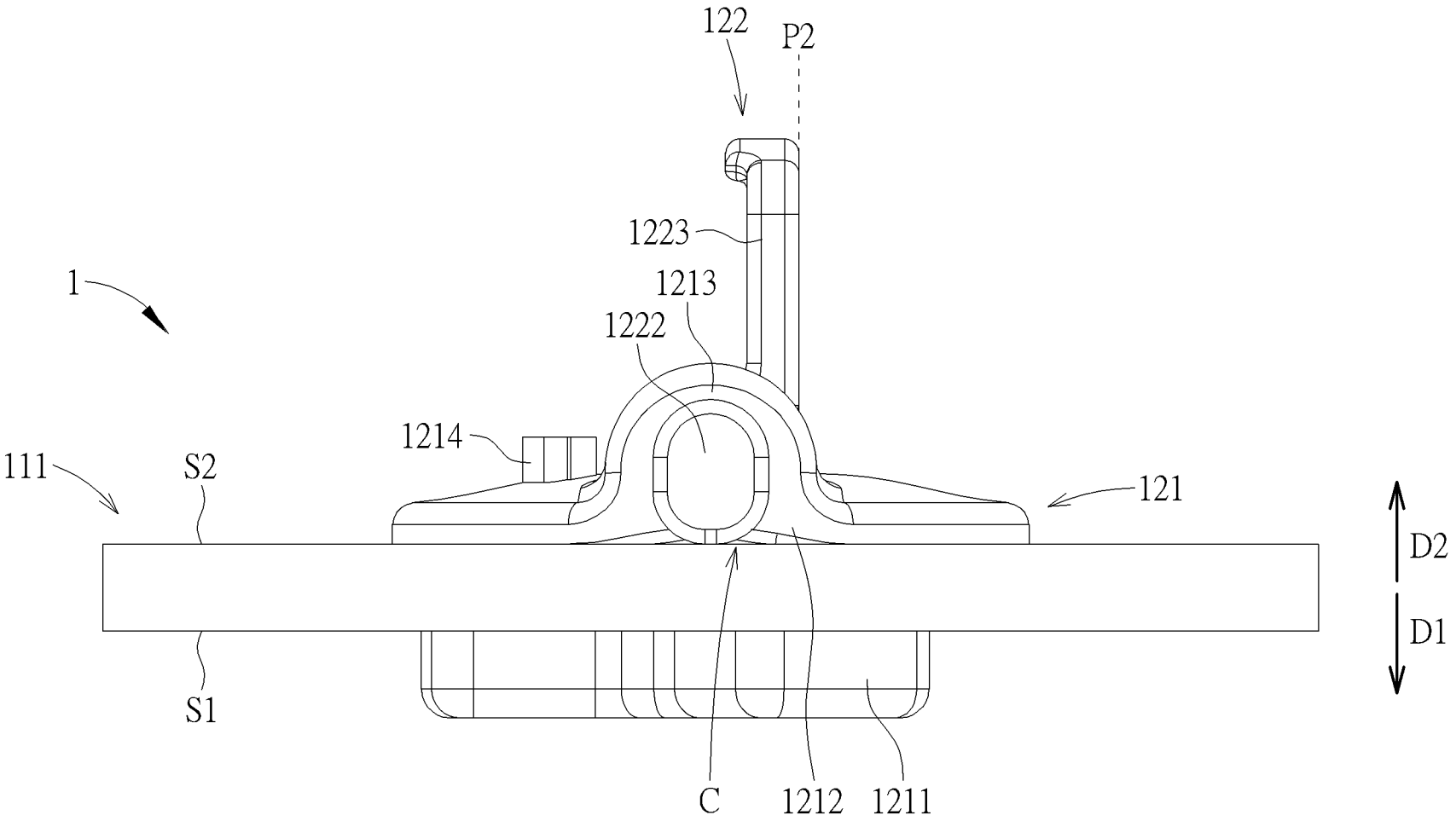
Figure 9:
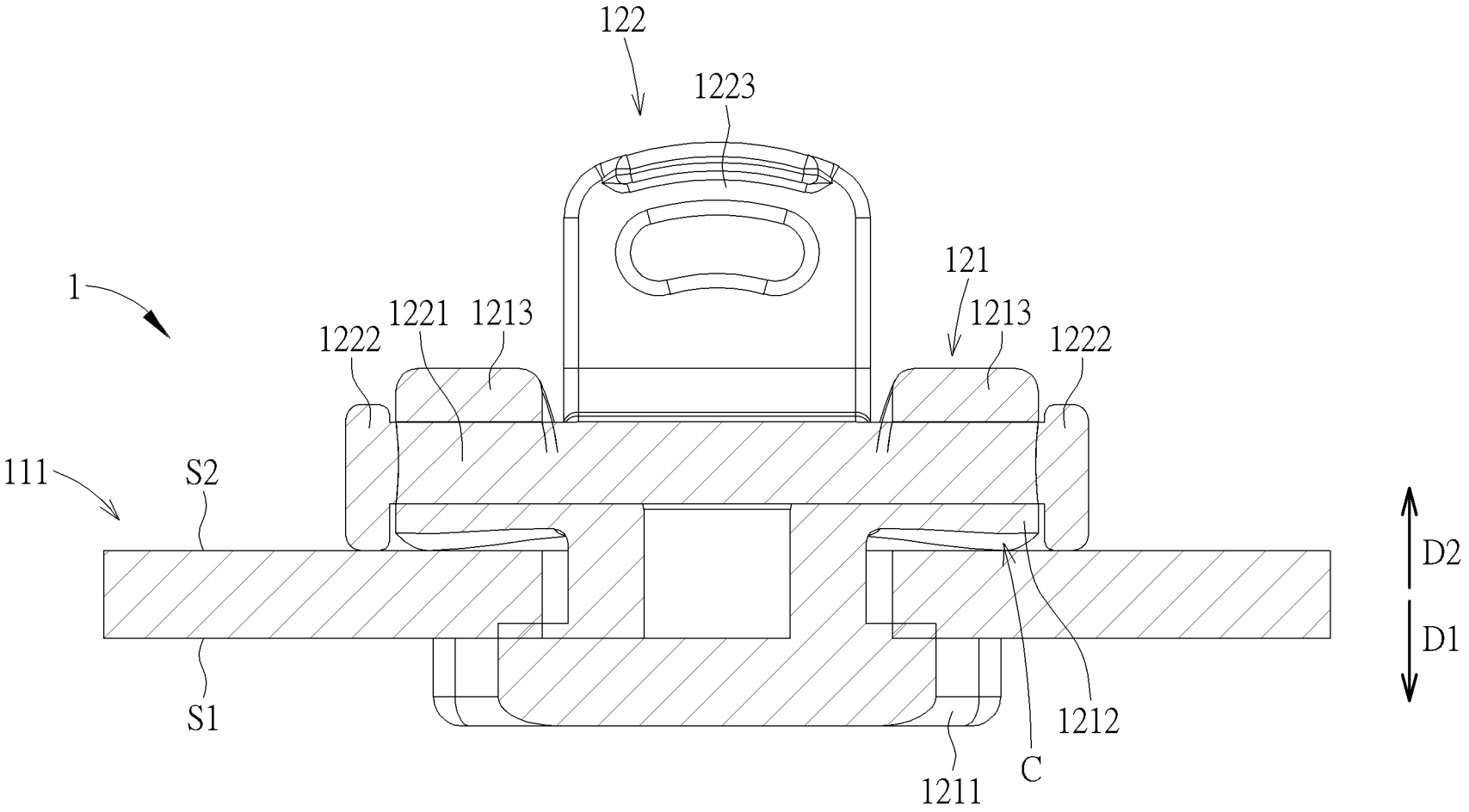
FIG. 9 is a partial sectional diagram of the container kit as the operating member is located at the second position according to the first embodiment of the present invention.

Please refer to FIG. 4 to FIG. 9. FIG. 4 and FIG. 5 are partial diagrams of the container kit 1 at different views as the operating member 122 is located at the first position P1 according to the first embodiment of the present invention. FIG. 6 is a partial sectional diagram of the container kit 1 as the operating member 122 is located at the first position P1 according to the first embodiment of the present invention. FIG. 7 and FIG. 8 are partial diagrams of the container kit 1 at different views as the operating member 122 is located at the second position P2 according to the first embodiment of the present invention. FIG. 9 is a partial sectional diagram of the container kit 1 as the operating member 122 is located at the second position P2 according to the first embodiment of the present invention. As shown in FIG. 4 to FIG. 6, when the operating member 122 is located at the first position P1, i.e., when the control valve 12 is in the first state, the valve member 121 is not resiliently deformed by the operating member 122, such that the valve member 121 is attached on and resiliently deformed by the container 11 for allowing an airflow from the interior of the container 11 to the exterior environment only, so as to restrain balance of an interior air pressure of the container 11 and an exterior air pressure. As shown in FIG. 7 to FIG. 9, when the operating member 122 is operated to the second position P2 from the first position P1 to switch the control valve 12 to the second state from the first state, the valve member 121 is resiliently deformed by the operating member 122, such that the valve member 121 is at least partially separated from the container 11 to provide a communication channel C formed between the valve member 121 and the container 11 for allowing both of an airflow from the interior of the container 11 to the exterior environment and an airflow from the exterior environment to the interior of the container 11, so as to allow the balance of the interior air pressure of the container 11 and the exterior air pressure.

Furthermore, as shown in FIG. 4 to FIG. 9, the valve member 121 is disposed through an opening structure O formed on a valve seat 111 of the container 11, and the valve member 121 includes an abutting portion 1211 and a covering portion 1212. The abutting portion 1211 is configured to abut against a first side S1 of the container 11. The covering portion 1212 is connected to the abutting portion 1211 and configured to be resiliently deformed by at least one of a second side S2 of the container 11 and the operating member 122. In this embodiment, the first side S1 and the second side S2 of the container 11 are an inner side and an outer side of the container 11, respectively, i.e., the abutting portion 1211 and the covering portion 1212 of the valve member 121 are located adjacent to the inner side and the outer side of the container 11, respectively.

Preferably, the valve member 121 can be a one-piece structure, i.e., the abutting portion 1211 and the covering portion 1212 can be integrally connected to each other, and the valve member 121 can be made of elastomeric material.

As shown in FIG. 4 to FIG. 6, the abutting portion 1211 abutting against the first side S1 of the container 11 is configured to provide a first acting force along a first direction D1 onto the covering portion 1212 for driving the covering portion 1212 to be attached on and resiliently deformed by the second side S2 of the container 11 when the operating member 122 is located at the first position P1, and the covering portion 1212 is not resiliently deformed by the operating member 122 when the operating member 122 is located at the first position P1. The covering portion 1212 of the valve member 121 in the first state allows an airflow from the interior of the container 11 to the exterior environment because the covering portion 1212 of the valve member 121 in the first state can be forced to be at least partially separated from the second side S2 of the container 11 by the airflow from the interior of the container 11 to the exterior environment. The covering portion 1212 of the valve member 121 in the first state blocks an airflow from the exterior environment to the interior of the container 11 because the covering portion 1212 of the valve member 121 in the first state can be forced to be attached on the second side S2 of the container 11 by the airflow from the exterior environment to the interior of the container 11.

As shown in FIG. 7 to FIG. 9, when the operating member 122 is located at the second position P2, the operating member 122 is configured to provide a second acting force along a second direction D2 opposite to the first direction D1 onto the covering portion 1212 for driving the covering portion 1212 to be resiliently deformed by the operating member 122 to be at least partially separated from the second side S2 of the container 11, so as to allow both of an airflow from the interior of the container 11 to the exterior environment and an airflow from the exterior environment to the interior of the container 11 for allowing the balance of the interior air pressure of the container 11 and the exterior air pressure.

Besides, as shown in FIG. 4 to FIG. 9, in this embodiment, the operating member 122 is pivotally disposed on the valve member 121. However, the present invention is not limited to this embodiment. For example, in another embodiment, the operating member can be pivotally disposed on the container.

Specifically, the operating member 122 includes a pivoting portion 1221, two driving portions 1222 and an operating portion 1223. The pivoting portion 1221 is pivotally connected to the valve member 121. The two driving portions 1222 protrude from two ends of the pivoting portion 1221, respectively, and the two driving portions 1222 are configured to abut against the container 11 when the operating member 122 is operated to the second position P2 from the first position P1. The operating portion 1223 is connected to the pivoting portion 1221 and configured to be operated to drive the pivoting portion 1221 to pivot, so as to switch the operating member 122 between the first position P1 and the second position P2. However, the numbers and the configurations of the pivoting portion and the driving portion are not limited to this embodiment. For example, in another embodiment, the operating member can include one driving portion located at one end of the pivoting portion only. Alternatively, in another embodiment, the operating member can include two pivoting portions arranged coaxially with each other and two driving portions located at two distal ends of the two pivoting portions, respectively.

Preferably, in order to achieve a pivotal connection of the valve member 121 and the pivoting portion 1221 of the operating member 122, a through hole structure 1213 is formed on the valve member 121. The through hole structure 1213 can be integrally connected to the covering portion 1212 and located adjacent to the second side S2 of the container 11. The pivoting portion 1221 is formed in a round shaft structure and configured to pivotally pass through the through hole structure 1213, so as to be pivotally connected to the through hole structure 1213 and located adjacent to the second side S2 of the container 11. However, the present invention is not limited to this embodiment. For example, in another embodiment, the pivoting portion can be formed in a hook-shaped structure pivotally engaged with a shaft structure formed on the valve member.

Preferably, each of the two driving portions 1222 is formed in a cam shape. The two driving portions 1222 do not abut against the second side S2 of the container 11 when the operating member 122 is located at the first position P1, and the two driving portions 1222 abut against the second side S2 of the container 11 when the operating member 122 is located at the second position P2. During a movement of the operating member 122 from the first position P1 to the second position P2, the operating member 122 is moved away from the second side S2 of the container 11 along the second direction D2 for providing the second acting force along the second direction D2 onto the covering portion 1212 of the valve member 121 by abutment of the two driving portions 1222 and the second side S2 of the container 11, such that the covering portion 1212 of the valve member 121 is resiliently deformed along the second direction D2 by the operating member 122 to be at least partially separated from the second side S2 of the container 11.

Preferably, the operating member 122 is configured to abut against a stopping portion 1214 formed on the valve member 121, which can be integrally connected to the covering portion 1212, for stopping the operating member 122 at the first position P1 when the operating member 122 is located at the first position P1.

It should be noticed that when the operating member 122 is operated from the first position P1 to the second position P2 for devacuumizing the interior of the container 11, an airflow can be introduced from the exterior environment to the interior of the container 11 through the communication channel C formed between the valve member 121 and the container 11 for balancing the interior air pressure of the container 11 and the exterior air pressure. During balance of the interior air pressure of the container 11 and the exterior air pressure, the operating member 122 can be retained at the second position P2 by frictional forces between the two driving portions 1222 and the second side S2 of the container 11, so as to keep the communication channel C in a small size, such that the airflow through the communication channel C formed between the valve member 121 and the container 11 can produce audible sound, e.g., until the interior air pressure of the container 11 and the exterior air pressure are balanced or the differential pressure between the interior air pressure of the container 11 and the exterior air pressure decreases to zero substantially. Therefore, in this embodiment, it is easy for a user to recognize whether the interior air pressure of the container 11 and the exterior air pressure are balanced or not by hearing the audible sound during devacuumizing the interior of the container 11.

Figure 10:
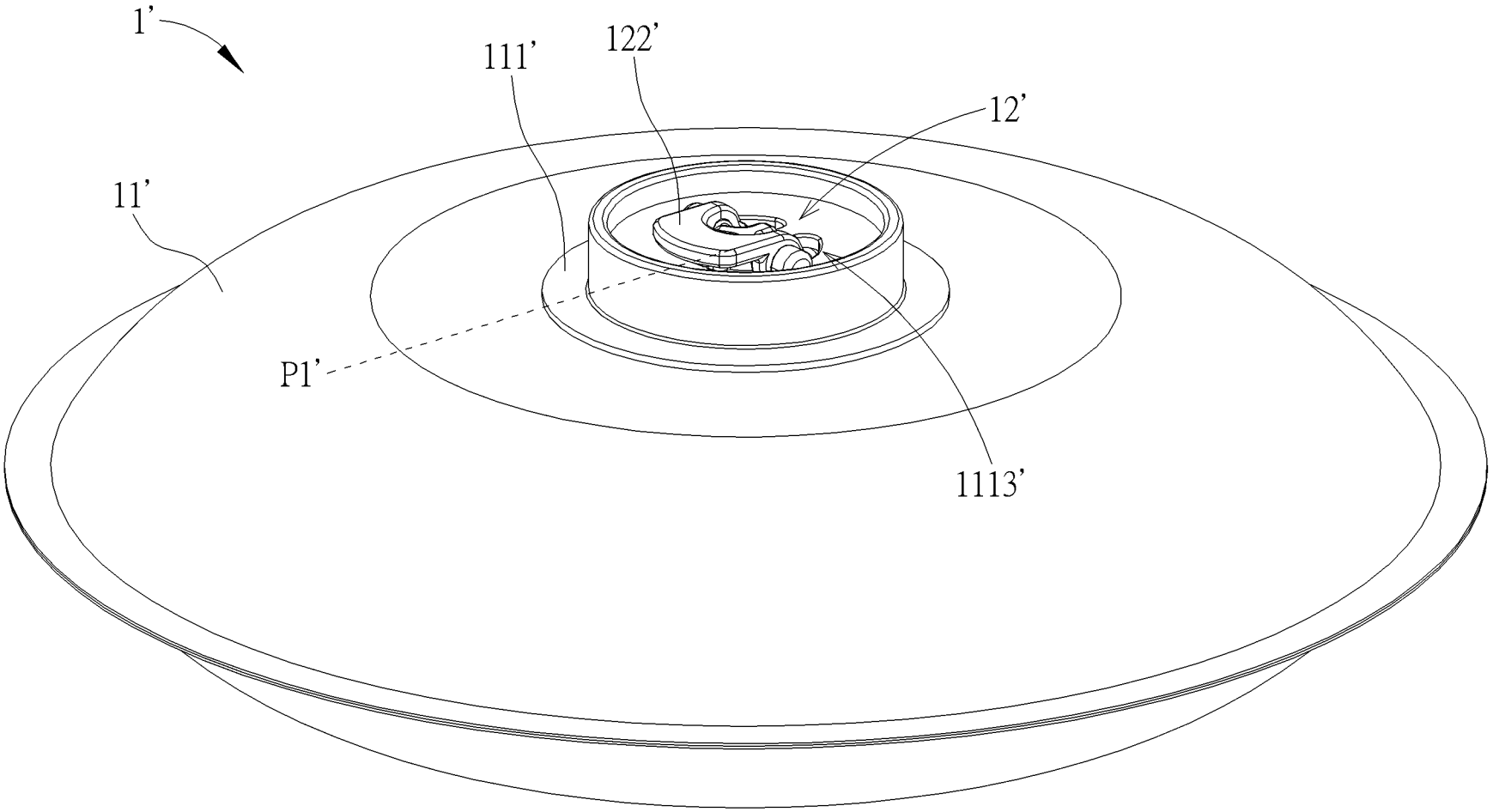
FIG. 10 and FIG. 11 are diagrams of a container kit in different states according to a second embodiment of the present invention.
Figure 11:
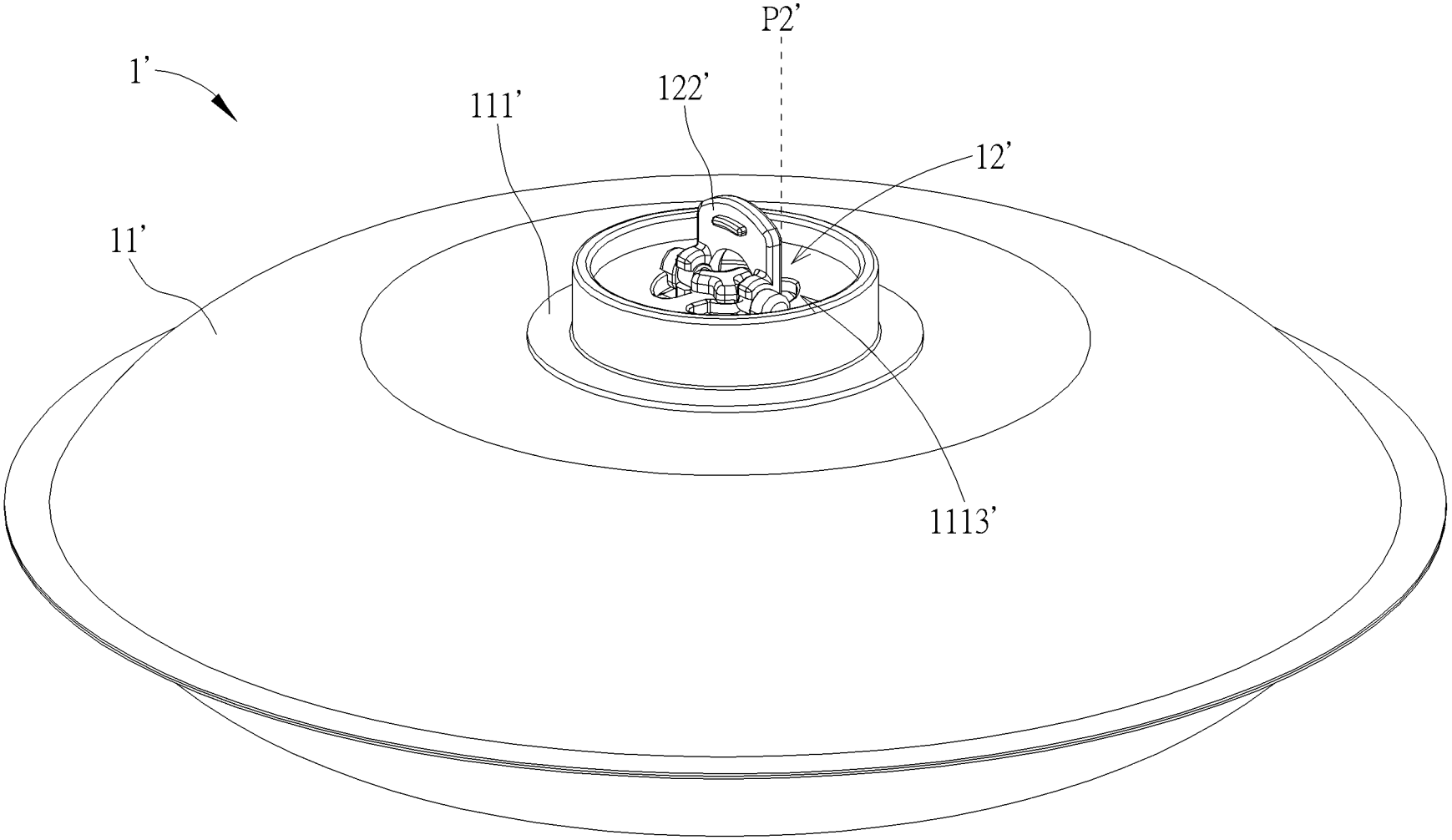
Figure 12:
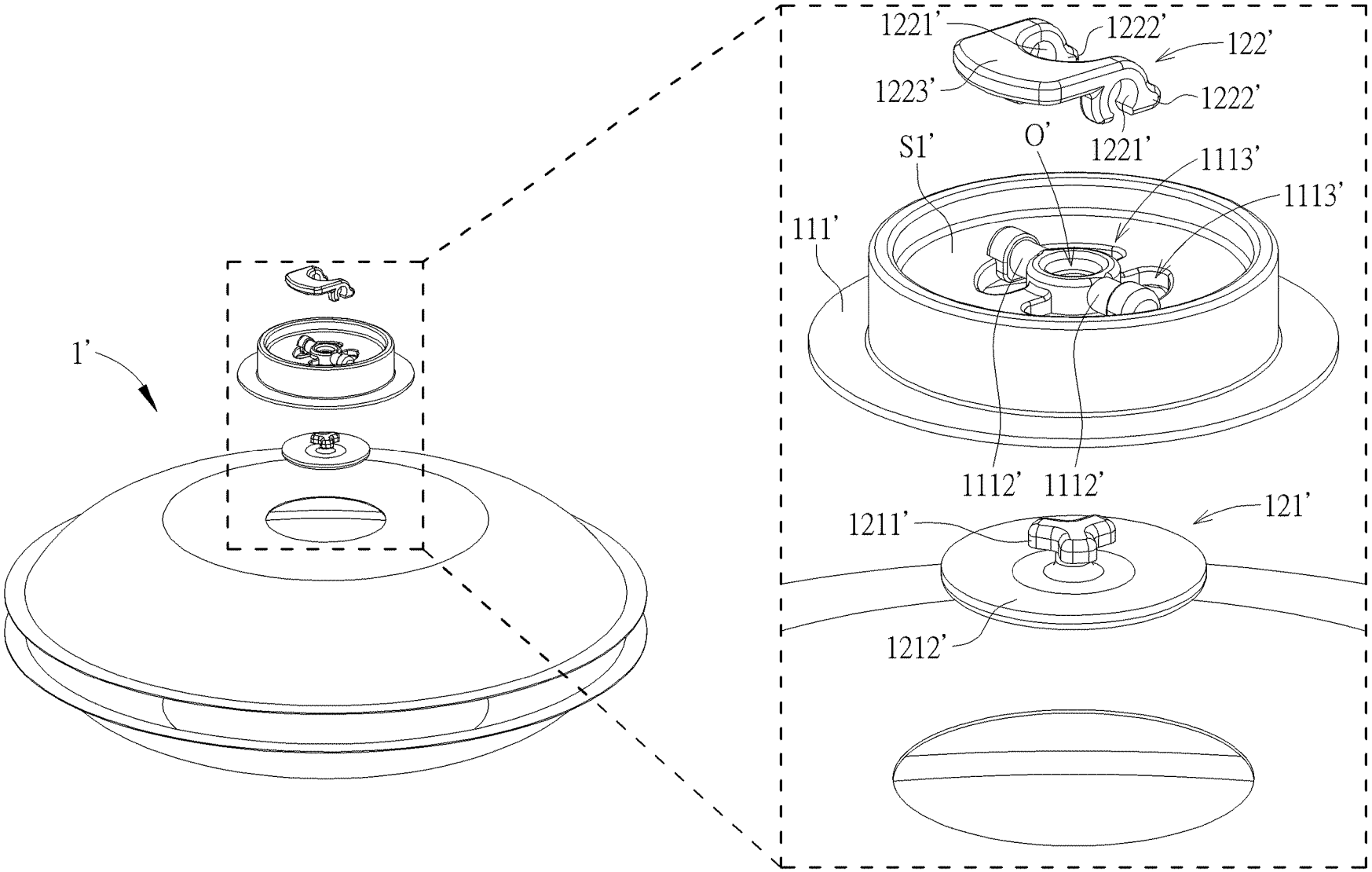
FIG. 12 is an exploded diagram of the container kit according to the second embodiment of the present invention.
Figure 13:
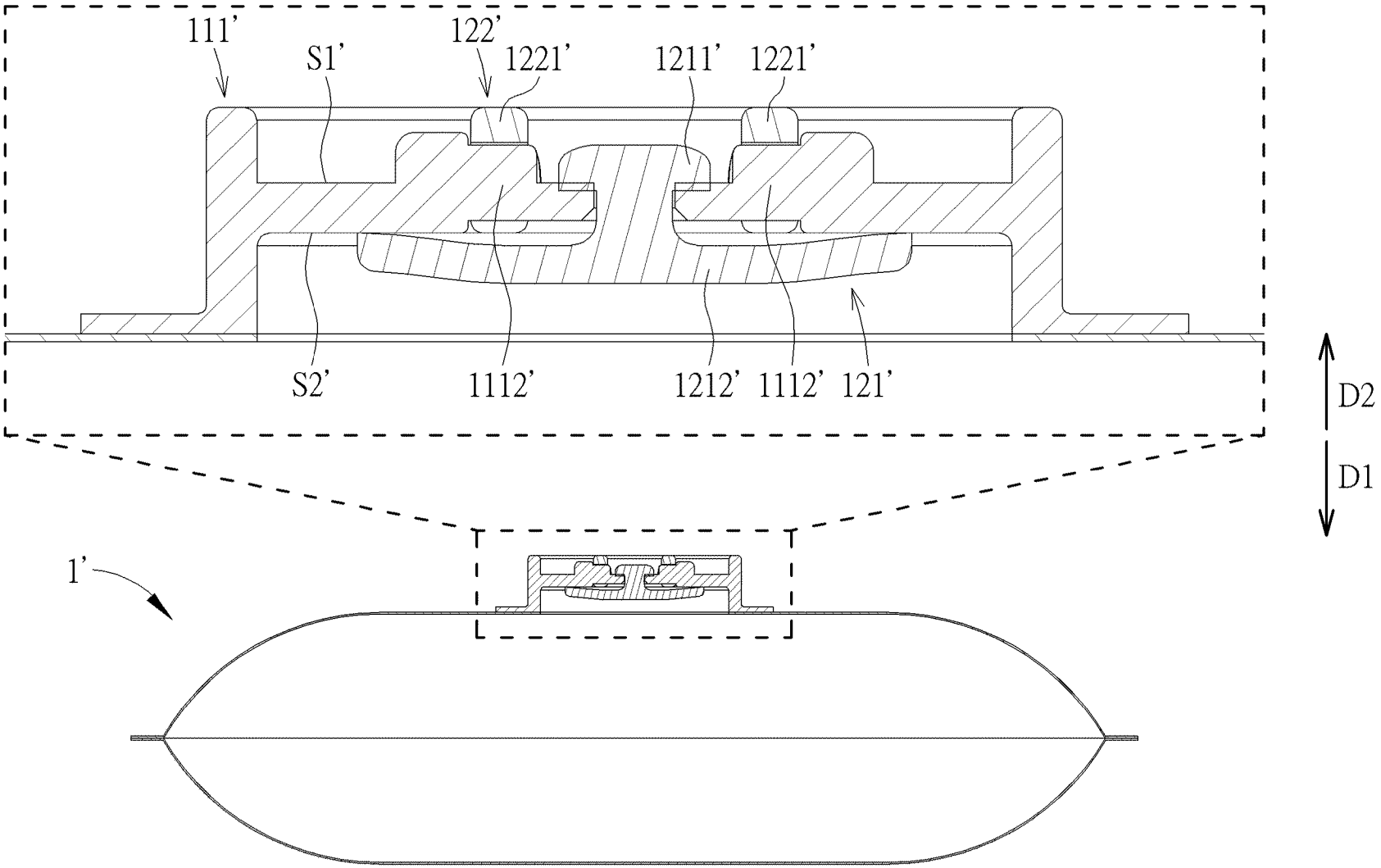
FIG. 13 and FIG. 14 are sectional diagrams of the container kit along different sectional lines as an operating member is located at a first position according to the second embodiment of the present invention.
Figure 14:
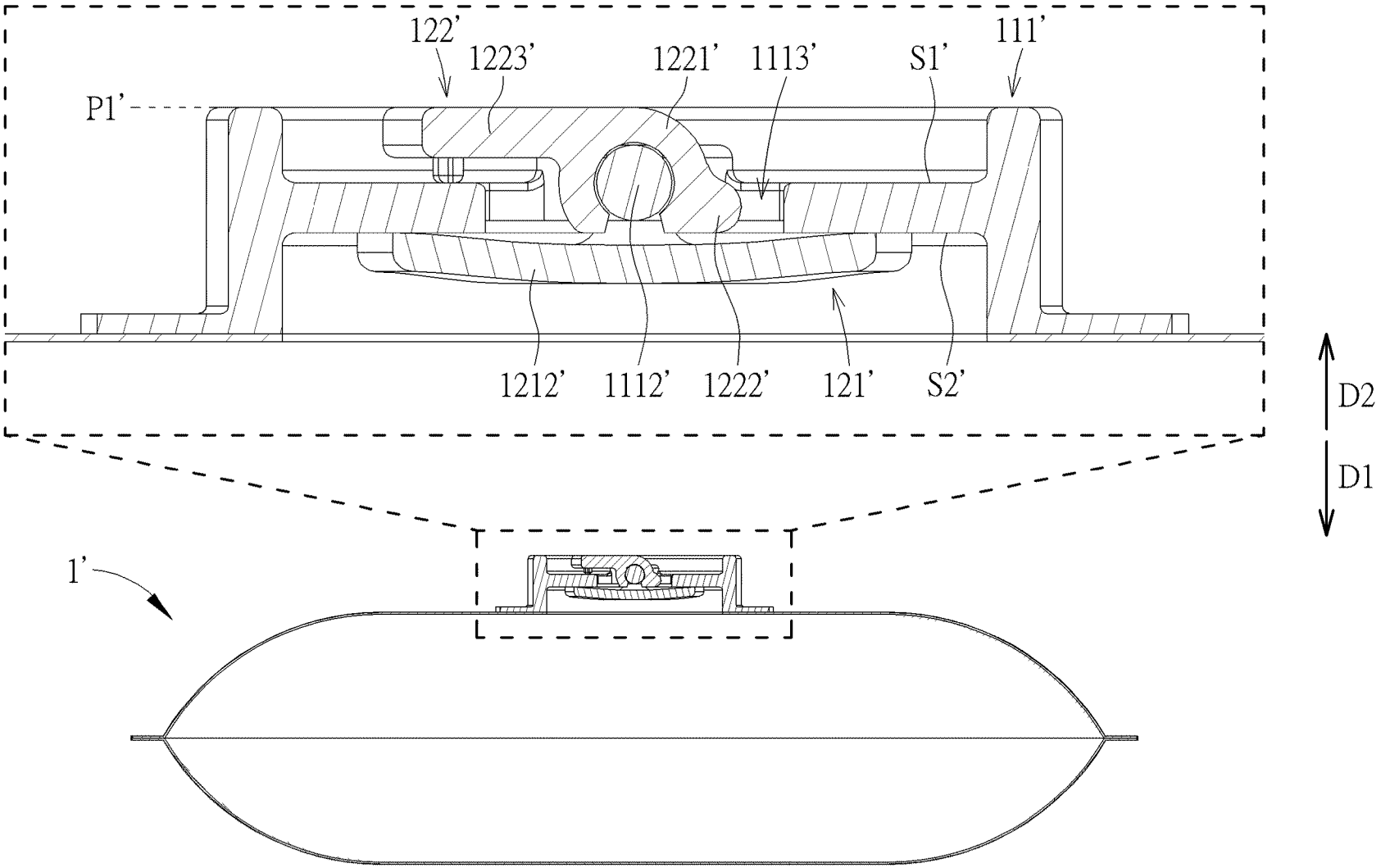
Figure 15:
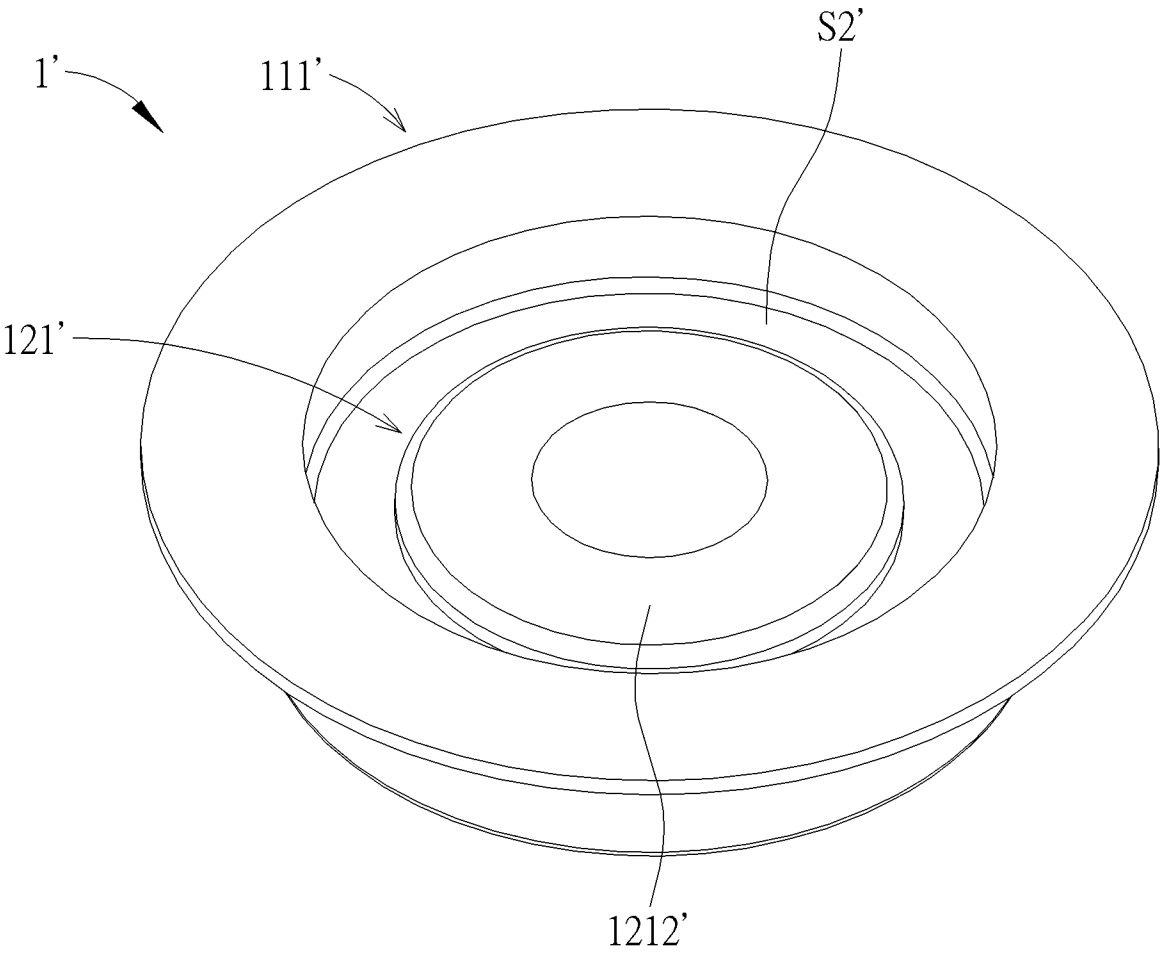
FIG. 15 is a partial diagram of the container kit as a valve member is not resiliently deformed by the operating member located at the first position according to the second embodiment of the present invention.
Figure 16:
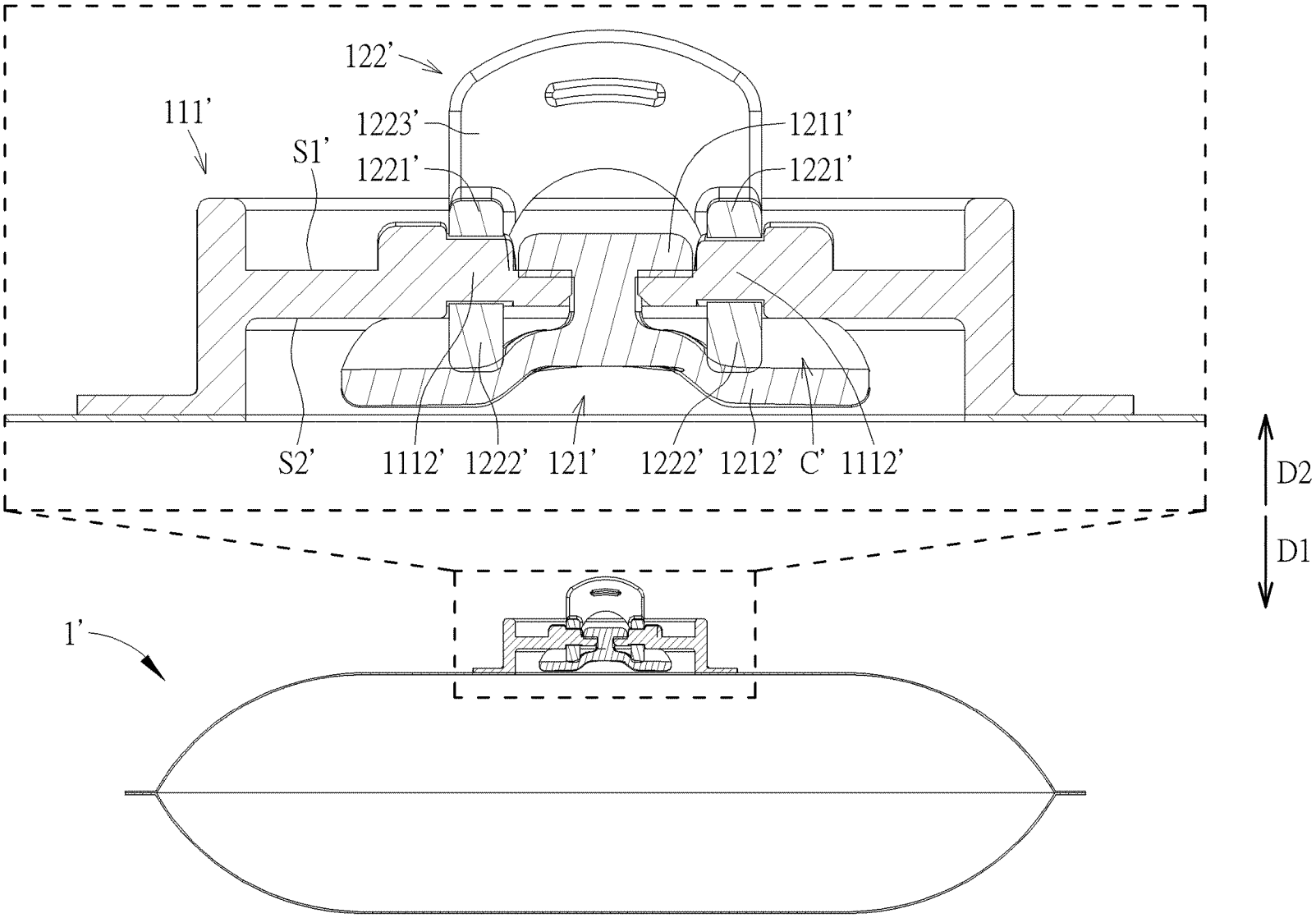
FIG. 16 and FIG. 17 are sectional diagrams of the container kit along different sectional lines as the operating member is located at a second position according to the second embodiment of the present invention.
Figure 17:
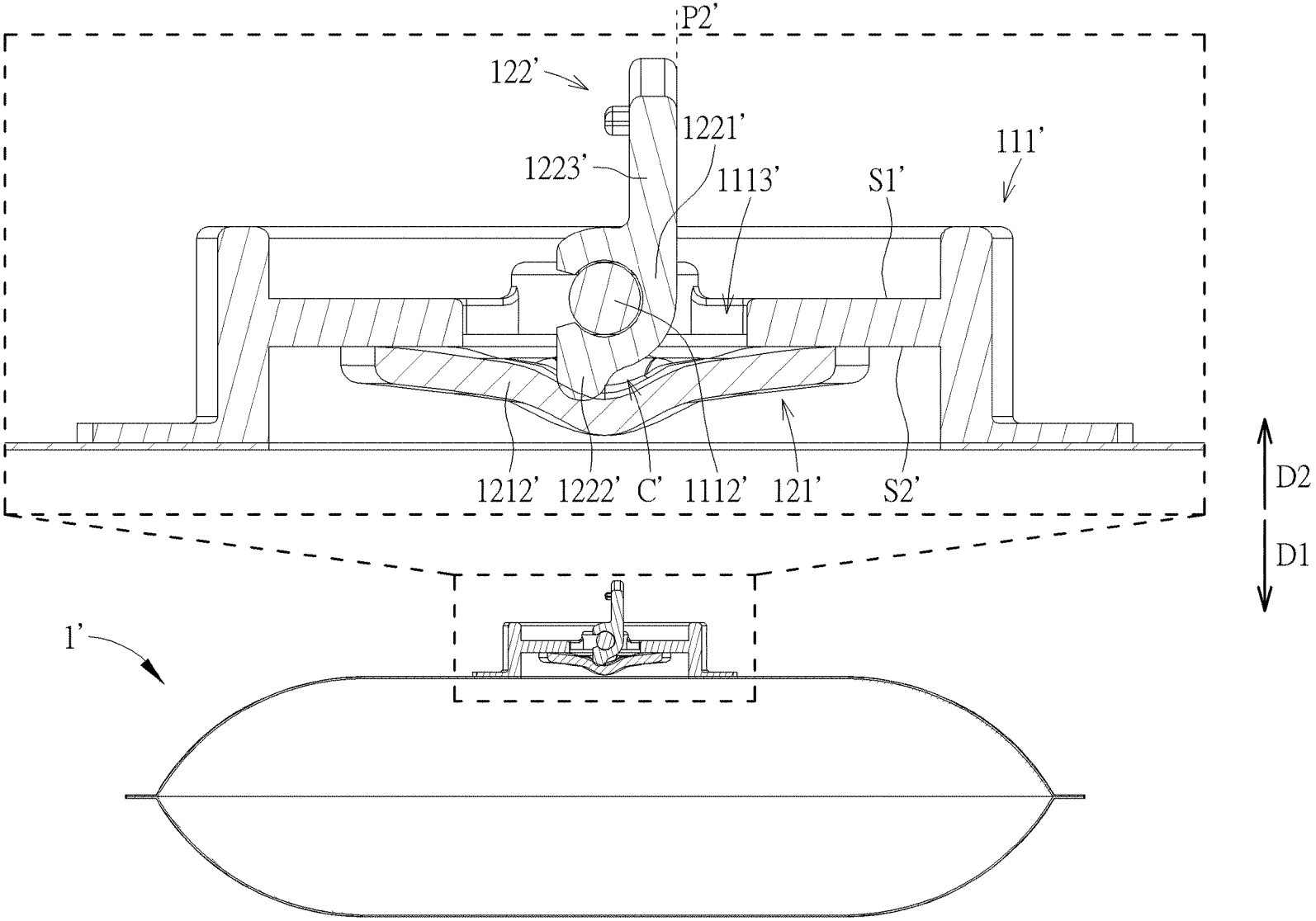
Figure 18:
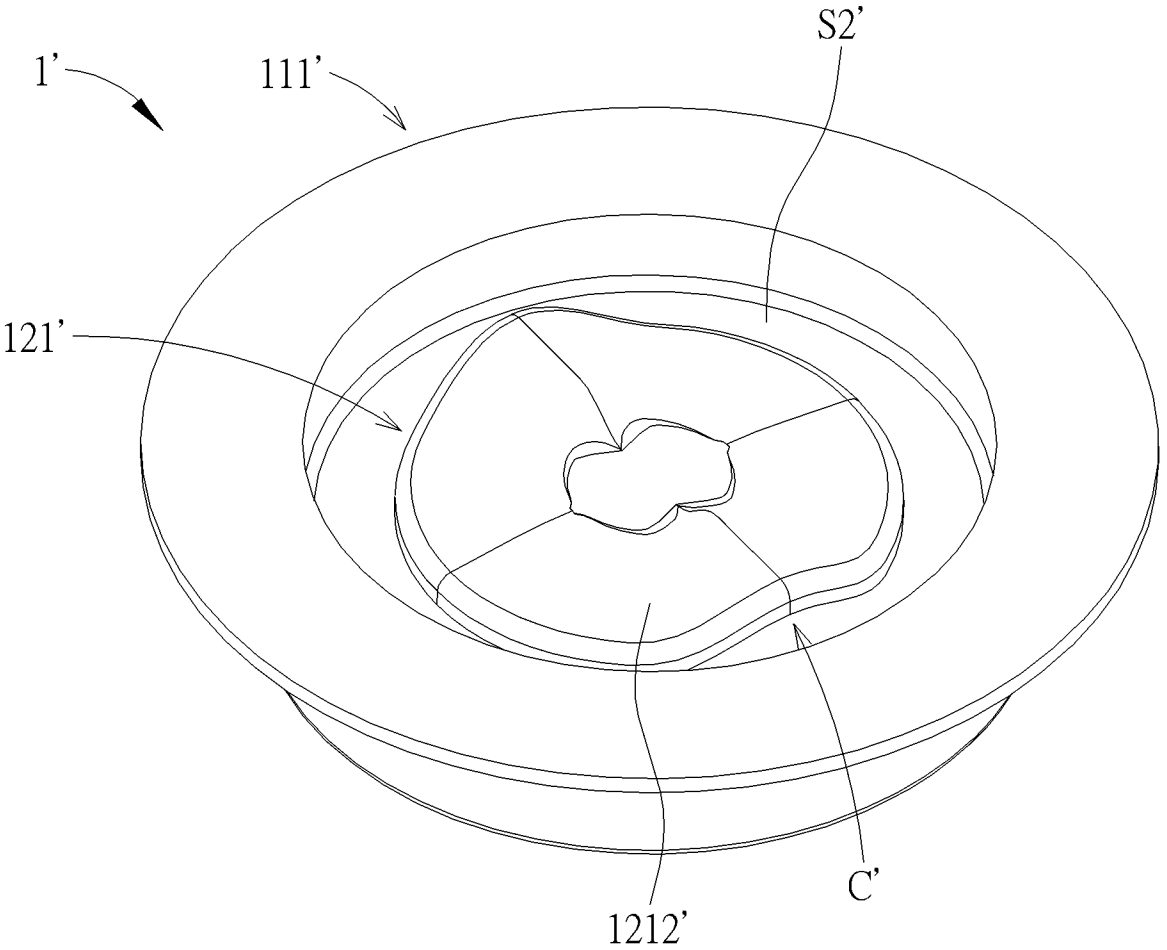
FIG. 18 is a partial diagram of the container kit as the valve member is resiliently deformed by the operating member located at the second position according to the second embodiment of the present invention.

Please refer to FIG. 10 to FIG. 18. FIG. 10 and FIG. 11 are diagrams of a container kit 1' in different states according to a second embodiment of the present invention. FIG. 12 is an exploded diagram of the container kit 1' according to the second embodiment of the present invention. FIG. 13 and FIG. 14 are sectional diagrams of the container kit 1' along different sectional lines as an operating member 122' is located at a first position P1' according to the second embodiment of the present invention. FIG. 15 is a partial diagram of the container kit 1' as a valve member 121' is not resiliently deformed by the operating member 122' located at the first position P1' according to the second embodiment of the present invention. FIG. 16 and FIG. 17 are sectional diagrams of the container kit 1' along different sectional lines as the operating member 122' is located at a second position P2' according to the second embodiment of the present invention. FIG. 18 is a partial diagram of the container kit 1' as the valve member 121' is resiliently deformed by the operating member 122' located at the second position P2' according to the second embodiment of the present invention. As shown in FIG. 10 to FIG. 12, the container kit 1' includes a container 11' and a control valve 12'. Different from the first embodiment, in this embodiment, the container 11' is a soft bag. Besides the control valve 12' is configured to allow an airflow from an exterior environment to an interior of the container 11' only for pressurizing the interior of the container 11' when the control valve 12' is in a first state as shown in FIG. 10, and the control valve 12' is further configured to allow both of an airflow from the exterior environment to the interior of the container 11' and an airflow from the interior of the container 11' to the exterior environment for depressurizing the interior of the container 11' when the control valve 12' is in a second state as shown in FIG. 11.

Furthermore, as shown in FIG. 12 to FIG. 18, in this embodiment, a first side S1' and a second side S2' of the container 11' are an outer side and an inner side of the container 11', respectively, i.e., an abutting portion 1211' and a covering portion 1212' of the valve member 121' disposed through an opening structure O' on a valve seat 111' of the container 11' are located adjacent to the outer side and the inner side of the container 11', respectively.

Besides, as shown in FIG. 12 to FIG. 18, in this embodiment, the operating member 122' is pivotally disposed on the valve seat 111' of the container 11'.

Specifically, in this embodiment, the operating member 122' includes two pivoting portions 1221', two driving portions 1222' and an operating portion 1223' connected to the two pivoting portions 1221'. The two pivoting portions 1221' of the operating member 122' are arranged coaxially with each other and pivotally connected to the valve seat 111' of the container 11'. The two driving portions 1222' protrude from the two pivoting portions 1221', respectively, and the two driving portions 1222' are configured to abut against the covering portion 1212' of the valve member 121' when the operating member 122' is operated to the second position P2' from the first position P1'.

Preferably, in this embodiment, two shaft structures 1112' are formed on the valve seat 111' of the container 11', and each of the two pivoting portions 1221' is formed in a hook-shaped structure and configured to be pivotally connected to the corresponding shaft structure 1112'.

Preferably, in this embodiment, two penetrating slots 1113' are formed on the valve seat 111' of the container 11' and configured to provide access for the two driving portions 1222' to abut against the covering portion 1212' of the valve member 121' located adjacent to the second side S2' of the container 11'. Furthermore, the two penetrating slots 1113' are configured to be covered by the covering portion 1212' of the valve member 121', so as to prevent an airflow from the interior of the container 11' to the exterior environment through any of the two penetrating slots 1113' when the operating member 122' is located at the first position P1.

Preferably, in this embodiment, the operating member 122' is configured to abut against the valve seat 111' for stopping the operating member 122' at the first position P1' when the operating member 122' is located at the first position P1'.

However, the present invention is not limited to this embodiment. For example, in another embodiment, there can be only one shaft structure and one penetrating slot formed on the valve seat of the container, and the operating member can include one pivoting portion pivotally connected to the shaft structure and one driving portion protruding from the pivoting portion. Alternatively, in another embodiment, the pivoting portion can be formed in a round shaft structure pivotally passing through a through hole structure formed on the valve seat.

As shown in FIG. 10 and FIG. 13 to FIG. 15, in this embodiment, each of the two driving portions 1222' does not abut against the covering portion 1212' of the valve member 121' when the operating member 122' is located at the first position P1', and as shown in FIG. 11 and FIG. 16 to FIG. 18, each of the two driving portions 1222' abuts against the covering portion 1212' of the valve member 121' when the operating member 122' is located at the second position P2'.

Besides, as shown in FIG. 10 and FIG. 13 to FIG. 15, the abutting portion 1211' abutting against the first side S1' of the container 11' is configured to provide a third acting force along the second direction D2 onto the covering portion 1212' for driving the covering portion 1212' to be attached on and resiliently deformed by the second side S2' of the container 11' when the operating member 122' is located at the first position P1', and the covering portion 1212' is not resiliently deformed by the operating member 122' when the operating member 122' is located at the first position P1'. The covering portion 1212' of the valve member 121' in the first state blocks an airflow from the interior of the container 11' to the exterior environment because the covering portion 1212' of the valve member 121' in the first state can be forced to be attached on the second side S2' of the container 11' by the airflow from the interior of the container 11' to the exterior environment. The covering portion 1212' of the valve member 121' in the first state allows an airflow from the exterior environment to the interior of the container 11' because the covering portion 1212' of the valve member 121' in the first state can be forced to be at least partially separated from the second side S2' of the container 11' by the airflow from the exterior environment to the interior of the container 11'.

As shown in FIG. 13 to FIG. 18, when the operating member 122' is operated from the first position P1' to the second position P2' for depressurizing the interior of the container 11', the operating member 122' is configured to provide a fourth acting force along the first direction D1 onto the covering portion 1212' of the valve member 121' by abutment of the two driving portions 1222' and the covering portion 1212', such that the covering portion 1212' of the valve member 121' is resiliently deformed along the first direction D1 by the operating member 122' to be at least partially separated from the second side S2' of the container 11' to provide a communication channel C' formed between the valve member 121' and the container 11' for introducing an airflow from the interior of the container 11' to the exterior environment, so as to balance the interior air pressure of the container 11' and the exterior air pressure. During balance of the interior air pressure of the container 11' and the exterior air pressure, the operating member 122' can be retained at the second position P2' by frictional forces between the two driving portions 1222' and the covering portion 1212', so as to keep the communication channel C' in a small size, such that the airflow from the interior of the container 11' to the exterior environment through the communication channel C' can produce audible sound, e.g., until the interior air pressure of the container 11' and the exterior air pressure are balanced or the differential pressure between the interior air pressure of the container 11' and the exterior air pressure decreases to zero substantially. Therefore, in this embodiment, it is easy for a user to recognize whether the interior air pressure of the container 11' and the exterior air pressure are balanced or not by hearing the audible sound.

Other details of this embodiment are the same as the one of the first embodiment. Detailed description is omitted herein for simplicity.

In contrast to the prior art, the control valve of the present invention can be switched between different states by operating the operating member to different positions for allowing or restraining balance of an interior air pressure of the container and an exterior air pressure. Therefore, the present invention has easy operation. Furthermore, when the operating member is located at the second position, the audible sound can be produced by the airflow through the communication channel formed between the valve member and the container, e.g., until the interior air pressure of the container and the exterior air pressure are balanced. Therefore, it is easy for a user to recognize whether the interior air pressure of the container and the exterior air pressure are balanced or not by hearing the audible sound.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A control valve adapted for a container, the control valve comprising:

a valve member configured to be mounted on the container and resiliently deformable; and an operating member pivotally disposed on one of the valve member and the container and pivotally switchable between a first position and a second position, when the operating member is operated to the second position from the first position, the valve member being resiliently deformed by the operating member, such that the valve member is at least partially separated from the container, the operating member comprising:

at least one pivoting portion pivotally connected to the one of the valve member and the container; and at least one driving portion protruding from the at least one pivoting portion and configured to abut against another one of the valve member and the container when the operating member is operated to the second position from the first position;

wherein the at least one driving portion is formed in a cam shape, the at least one driving portion does not abut against the another one of the valve member and the container when the operating member is located at the first position, and the at least one driving portion abuts against the another one of the valve member and the container when the operating member is located at the second position.

2. The control valve of claim 1, wherein the valve member comprises:

an abutting portion configured to abut against a first side of the container; and a covering portion connected to the abutting portion and configured to be resiliently deformed by at least one of a second side of the container and the operating member.

3. The control valve of claim 2, wherein the covering portion is not resiliently deformed by the operating member when the operating member is located at the first position, and the covering portion is resiliently deformed by the operating member to be at least partially separated from the second side of the container when the operating member is located at the second position.

4. The control valve of claim 2, wherein the covering portion is attached on and resiliently deformed by the second side of the container when the operating member is located at the first position.

5. The control valve of claim 1, wherein the operating member further comprises:

an operating portion connected to the at least one pivoting portion and configured to be operated to drive the at least one pivoting portion to pivot, so as to switch the operating member between the first position and the second position.

6. The control valve of claim 1, wherein the at least one pivoting portion is configured to be pivotally connected to a through hole structure or a shaft structure formed on one of a covering portion of the valve member and a valve seat of the container.

7. The control valve of claim 1, wherein when the operating member is located at the second position, a communication channel is formed between the valve member and the container for producing an audible sound by an airflow through the communication channel.

8. A container kit comprising:

a container; and a control valve comprising:

a valve member configured to be mounted on the container and resiliently deformable; and an operating member pivotally disposed on one of the valve member and the container and pivotally switchable between a first position and a second position, when the operating member is operated to the second position from the first position, the valve member being resiliently deformed by the operating member, such that the valve member is at least partially separated from the container, the operating member comprising:

at least one pivoting portion pivotally connected to the one of the valve member and the container; and at least one driving portion protruding from the at least one pivoting portion and configured to abut against another one of the valve member and the container when the operating member is operated to the second position from the first position;

wherein the at least one driving portion is formed in a cam shape, the at least one driving portion does not abut against the another one of the valve member and the container when the operating member is located at the first position, and the at least one driving portion abuts against the another one of the valve member and the container when the operating member is located at the second position.

9. The container kit of claim 8, wherein the valve member comprises:

an abutting portion configured to abut against a first side of the container; and a covering portion connected to the abutting portion and configured to be resiliently deformed by at least one of a second side of the container and the operating member.

10. The container kit of claim 9, wherein the covering portion is not resiliently deformed by the operating member when the operating member is located at the first position, and the covering portion is resiliently deformed by the operating member to be at least partially separated from the second side of the container when the operating member is located at the second position.

11. The container kit of claim 9, wherein the covering portion is attached on and resiliently deformed by the second side of the container when the operating member is located at the first position.

12. The container kit of claim 8, wherein the operating member further comprises:

an operating portion connected to the at least one pivoting portion and configured to be operated to drive the at least one pivoting portion to pivot, so as to switch the operating member between the first position and the second position.

13. The container kit of claim 8, wherein the at least one pivoting portion is configured to be pivotally connected to a through hole structure or a shaft structure formed on one of a covering portion of the valve member and a valve seat of the container.

14. The container kit of claim 8, wherein when the operating member is located at the second position, a communication channel is formed between the valve member and the container for producing an audible sound by an airflow through the communication channel.

* * * * *